US006742469B2

(12) United States Patent
Kapsner et al.

(10) Patent No.: US 6,742,469 B2
(45) Date of Patent: Jun. 1, 2004

(54) DEVICE AND METHOD FOR HANDLING A BOAT SUNDECK

(75) Inventors: Kevin John Kapsner, Little Falls, MN (US); Gregory Herman Rohr, Little Falls, MN (US)

(73) Assignee: Larson/Glastron Boats, Inc., Minneapolis, MN (US)

( * ) Notice: Subject to any disclaimer, the term of this patent is extended or adjusted under 35 U.S.C. 154(b) by 0 days.

(21) Appl. No.: 10/027,056

(22) Filed: Dec. 21, 2001

(65) Prior Publication Data

US 2002/0166489 A1 Nov. 14, 2002

Related U.S. Application Data

(60) Provisional application No. 60/257,665, filed on Dec. 21, 2000.

(51) Int. Cl.[7] ..... B63B 17/00

(52) U.S. Cl. ..... 114/364; 114/355; 414/751.1; 294/81.1; 294/81.6

(58) Field of Search ..... 114/65 R, 343, 114/355, 362, 364; 414/10, 11, 142.6, 142.7, 137.1, 751.1, 753.1; 269/17, 905; 296/81.1, 81.41, 81.6, 67.2, 67.21, 67.22

(56) References Cited

U.S. PATENT DOCUMENTS 3,762,576 A * 10/1973 Castellano ..... 414/680
4,085,473 A * 4/1978 Franklin ..... 114/364
4,531,720 A * 7/1985 Söder ..... 269/71
4,810,151 A * 3/1989 Shern ..... 414/11
5,915,742 A * 6/1999 Hung ..... 29/281.5
D445,394 S * 7/2001 Wesson ..... D12/318

FOREIGN PATENT DOCUMENTS

SU 779189 * 11/1980 ..... 114/65 R
SU 1177201 * 9/1985 ..... 114/65 R
SU 1260289 * 9/1986 ..... 114/65 R

* cited by examiner

*Primary Examiner*—S. Joseph Morano
*Assistant Examiner*—Ajay Vasudeva
(74) *Attorney, Agent, or Firm*—Merchant & Gould P.C.

(57) ABSTRACT

A device for, and method of, handling and mounting a boat sundeck. The device includes a platform having first and second ends. A clamp structure is connected to the first end of the platform such that the clamp structure can be used to hold and move the sundeck of a boat. In addition, control modules are connected to the second end of the platform to aid in manipulation of the sundeck by the device. A lift connection location is positioned between the first and second ends of the platform and allows the device to be connected to an articulated boom.

1 Claim, 5 Drawing Sheets

DEVICE AND METHOD FOR HANDLING A BOAT SUNDECK

PRIORITY OF INVENTION

This application claims priority of invention under 35 U.S.C. §119(e) from U.S. Provisional application No. 60/257,665, filed Dec. 21, 2000, the disclosure of which is incorporated by reference herein.

FIELD OF THE INVENTION

The present invention relates generally to devices and methods for assembling products such as boats. More particularly, the present invention relates devices and methods for handling boat sundecks.

BACKGROUND OF THE INVENTION

Conventional boat manufacturing processes are typically quite labor intensive and involve a significant amount of manual lifting and positioning of component parts. What are needed are methods and devices for improving manufacturing efficiency on a boat assembly line.

SUMMARY OF THE INVENTION

One aspect of the present invention relates to a device for handling a boat sundeck. The device includes a platform having first and second ends. A clamp structure is connected to the first end of the platform such that the clamp structure can be used to hold and move the sundeck of a boat. In addition, control modules are connected to the second end of the platform to aid in manipulation of the sundeck by the device. A lift connection location is positioned between the first and second ends of the platform and allows the device to be connected to an articulated boom.

Another aspect of the present invention relates to a method for mounting a sundeck to a boat. The method includes providing a clamp structure including a moveable clamping member and a fixed clamping member. The method also includes maneuvering the clamp structure such that the moveable and fixed clamping members are located on either side of one end of a boat sundeck and then closing the clamp structure such that the device clamps the sundeck. The method further includes lifting the sundeck with a boom and lift assembly connected to the clamp structure and connecting the sundeck to the back of the boat (e.g., near the transom and over the engine) while the boom and lift assembly holds the clamped sundeck in the desired position.

A variety of advantages of the invention will be set forth in part in the description that follows, and in part will be apparent from the description, or may be learned by practicing the invention. It is to be understood that both the foregoing general description and the following detailed description are explanatory only and are not restrictive of the invention as claimed.

BRIEF DESCRIPTION OF THE DRAWINGS

The accompanying drawings, which are incorporated in and constitute a part of the specification, illustrate several aspects of the invention and together with the description, serve to explain the principles of the invention. A brief description of the drawings is as follows.

DETAILED DESCRIPTION

With reference now to the various drawings in which identical elements are numbered identically throughout, a description of various exemplary aspects of the present invention will now be provided.

Figure 1:
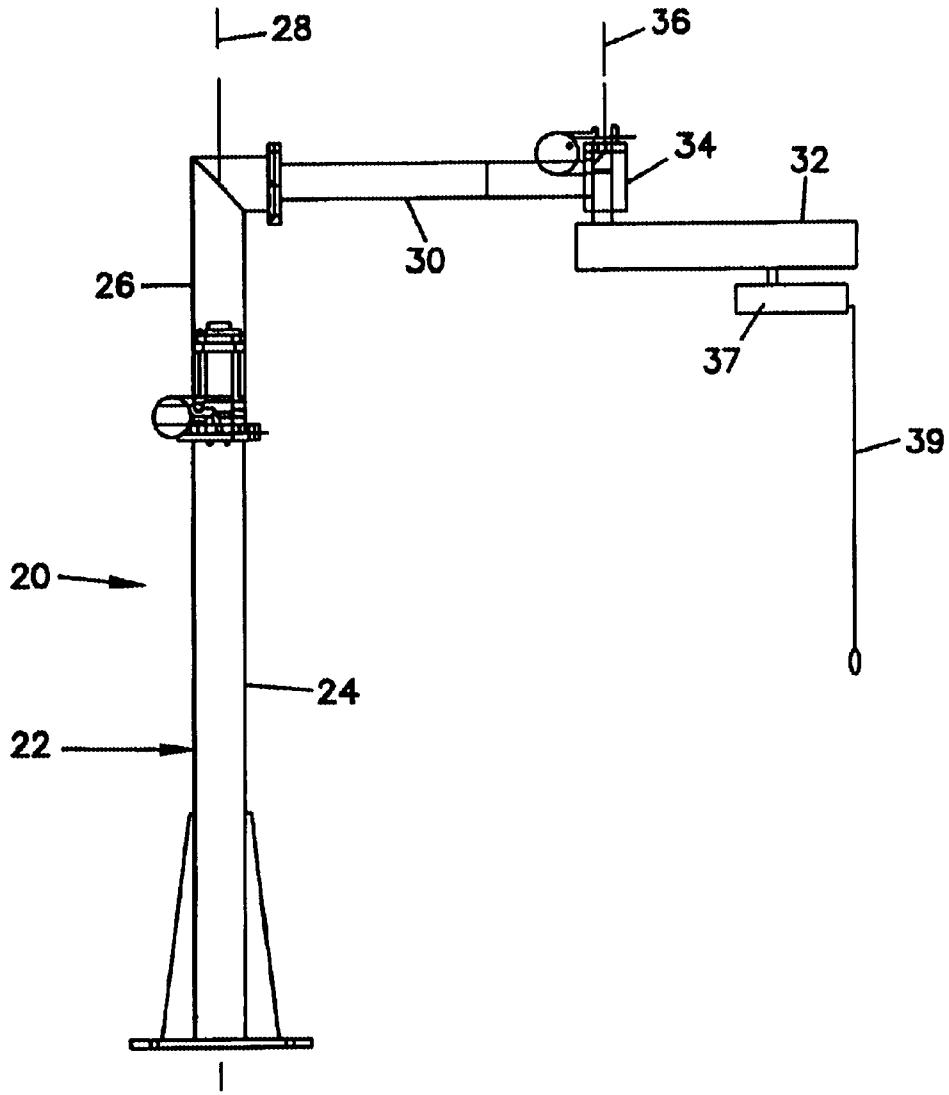
FIG. 1 is a side view of an articulated arm/boom suitable for use with an attachment constructed in accordance with the principles of the present invention.

FIG. 1 shows an articulated boom 20 (i.e., a jib or crane) suitable for use with a sundeck handling attachment constructed in accordance with the principles of the present invention. The articulated boom 20 includes a main post 22 having a base piece 24 and an upper extension 26. The upper extension 26 is free to pivot about a vertical axis 28 that extends longitudinally through the main post 22. A first arm 30 projects outwardly from the upper extension 26 in a cantilevered fashion. The far end of the first arm 30 is connected to a second arm 32 by a pivot mount 34. The pivot mount 34 allows the second arm 32 to pivot relative to the first arm 30 about a vertical axis 36. A lift 37 (i.e., a winch-like structure) for raising and lowering a flexible member 39 (e.g., a cable, rope, chain, etc.) is mounted on the second arm 32. It will be appreciated that articulated booms as described above are conventionally known in the art. For example, similar booms are manufactured and sold by GCI Company of Garfield, Minn. Additionally, lifts as described above are also known in the art. For example, a preferred lift is sold under the name Bal-Trol by Tri-Motion Industries of Tampa, Fla.

Figure 4:
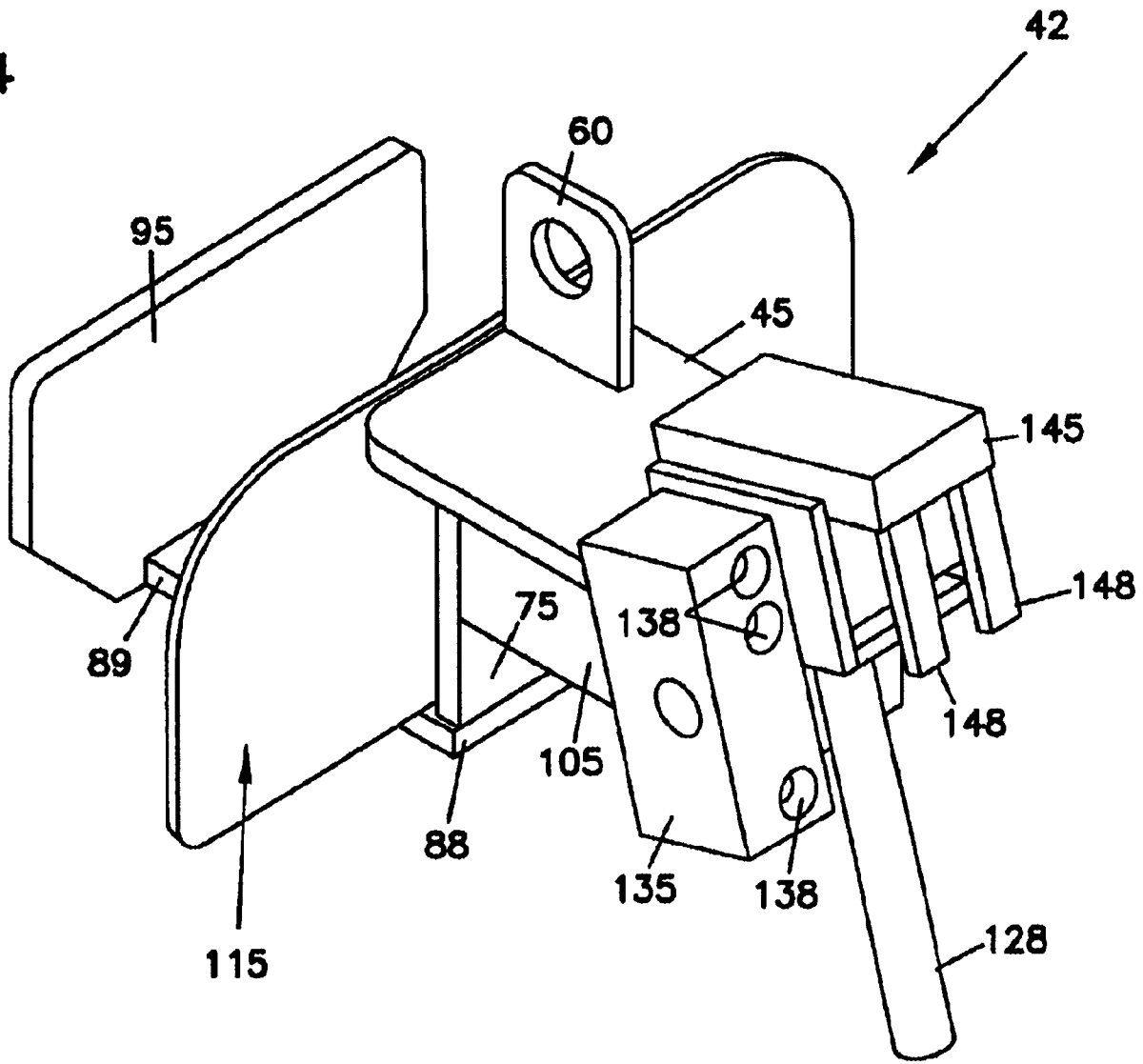
FIG. 4 is a back perspective view of the attachment.
Figure 5:
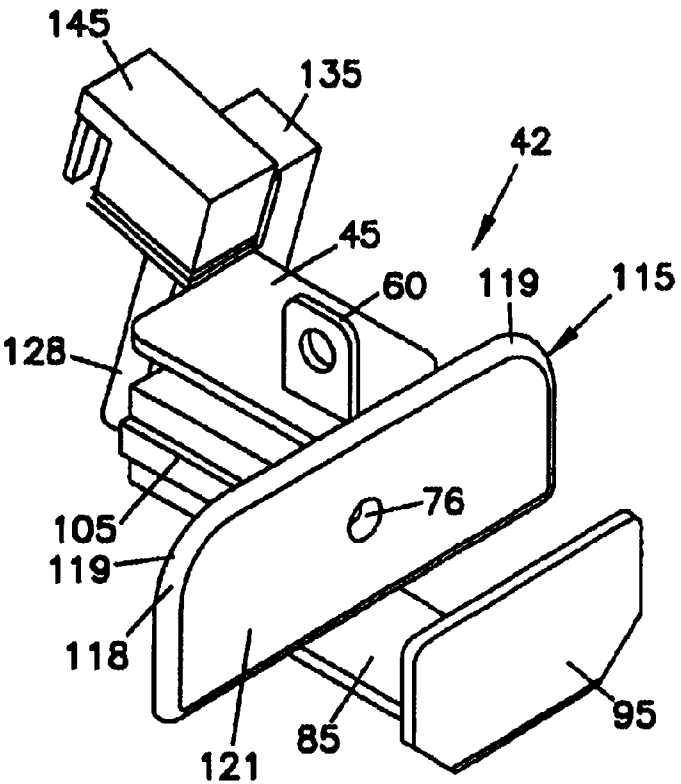
FIG. 5 is a front perspective view of the attachment.
Figure 6:
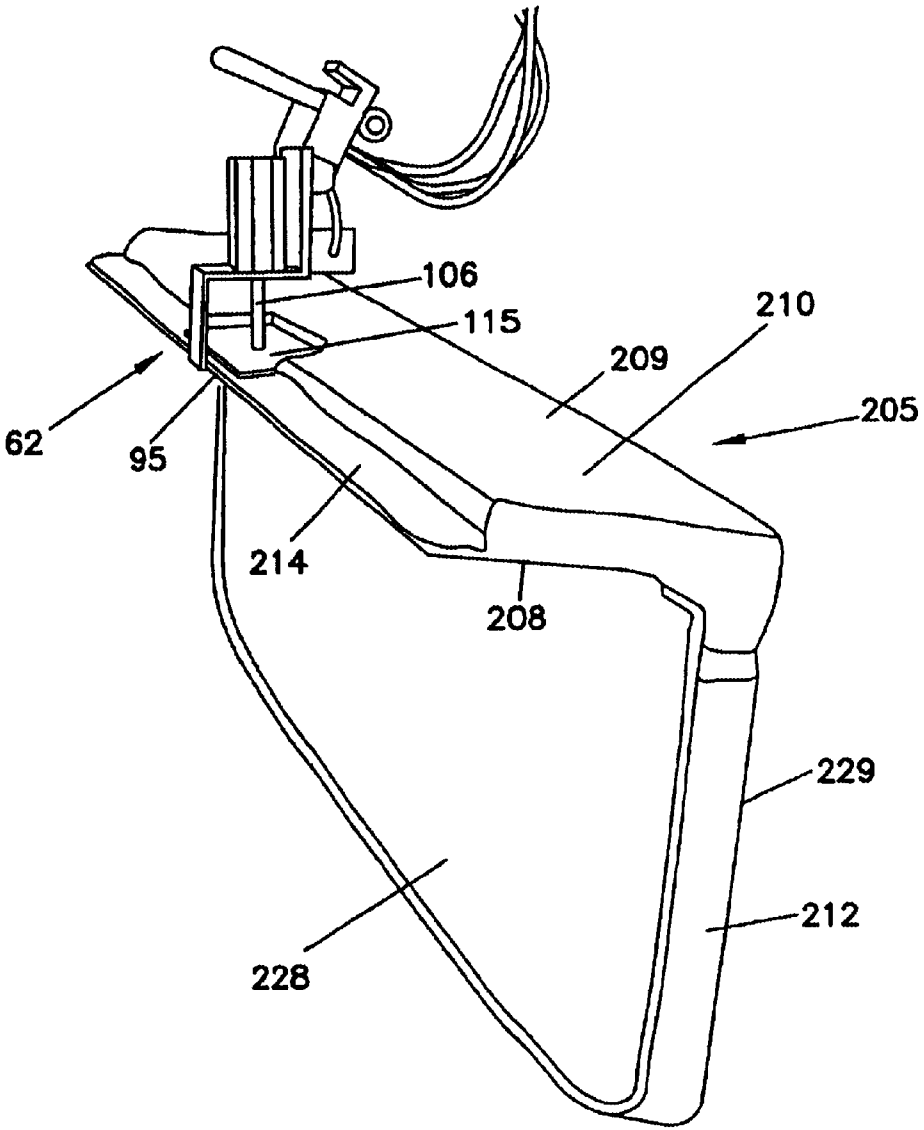
FIG. 6 is a perspective view of the attachment clamped onto a sundeck for a boat.

A sundeck handling attachment 42 constructed in accordance with the principles of the present invention is preferably connected to the lower end of the flexible member 39. It will be understood that the phrase "connected to" includes direct connections as well as connections made by intermediate pieces or structures. FIGS. 4–6 show the entire sundeck handling attachment 42, while FIGS. 2 and 3 show only a frame 43 of the handling attachment 42.

Figure 2:
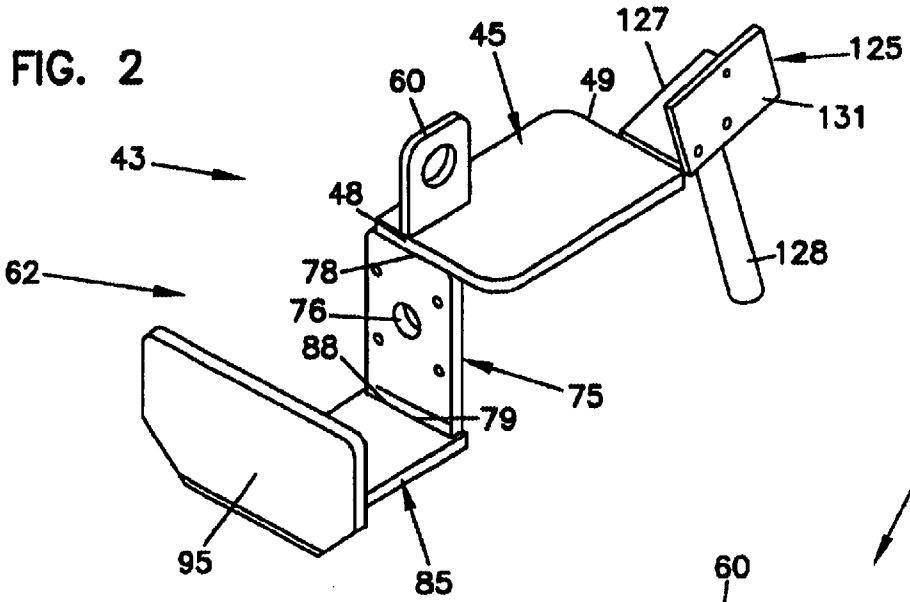
FIG. 2 is a perspective view of the frame of an articulated boom attachment constructed in accordance with the principles of the present invention.
Figure 3:
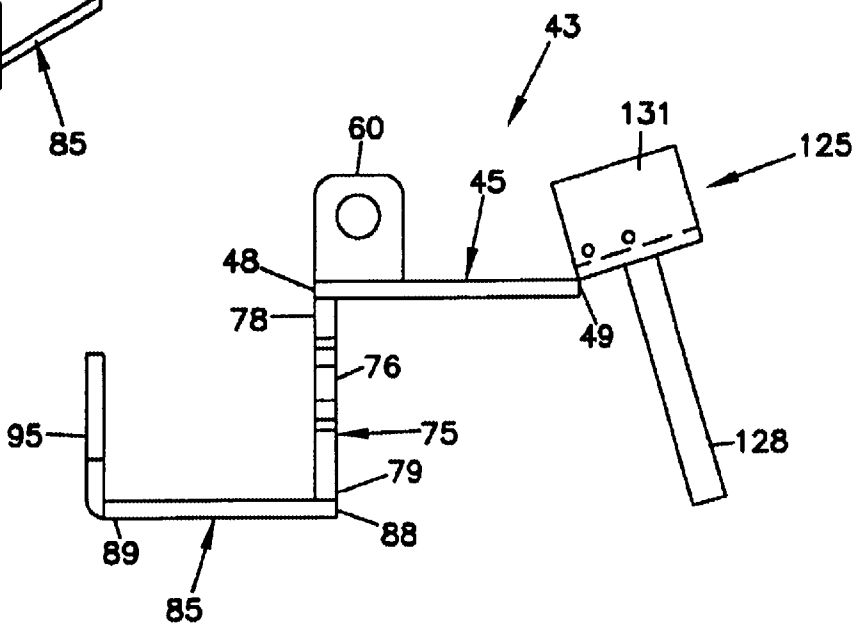
FIG. 3 is a side view of the frame of the attachment of FIG. 2.

Referring to FIGS. 2 and 3, the frame 43 includes a platform 45 with first and second ends 48 and 49. A lift connection location 60 (e.g., an eye, loop, hook, flange, opening, etc.) is positioned on the platform 45 between the first end 48 and second end 49. The frame 43 further includes a clamp structure 62 with a cylinder mount 75, spacer 85, and fixed clamping member 95. A first end 78 of the cylinder mount 75 is connected to the first end 48 of the platform such that the two structures run perpendicular to one another. The cylinder mount defines a piston hole 76. A second end 79 of the cylinder mount 75 is connected to a first end 88 of the spacer 85 such that the cylinder mount 75 and spacer 85 are perpendicular to one another. Finally, a second end 89 of spacer 85 is connected to the fixed clamping member 95 such that the two structures run perpendicular to one another.

Referring now to FIGS. 4 and 5, an air cylinder 105 is connected to the back of cylinder mount 75 and positioned such that piston 106 (shown in FIG. 6) of air cylinder 105 extends through piston hole 76 of cylinder mount 75. The end of the piston 106 is connected to a moveable clamping member 115 so that as the piston is actuated from a first retracted position to a second extended position, the moveable clamping member 115 is moved from a position close to the first end 88 of spacer 85 toward the second end 89 of spacer 85 so that the space between moveable clamping member 115 and fixed clamping member 95 is thereby reduced. When the piston 106 is actuated from a second position to a first position, the moveable clamping member 115 returns to its initial position, thereby increasing the space between moveable clamping member 115 and fixed clamping member 95.

The moveable clamping member 115 is generally rectangular and includes an outer edge 118 having a convex curvature. Upper corners 119 of moveable clamping member 115 are rounded. Preferably, the moveable clamping member 115 has a planar contact area 121 that is larger than an opposing contact area of the fixed clamping member 95. In one embodiment, the contact area of the moveable clamping member 115 is at least 50 percent larger than the contact area of the fixed clamping member 95.

Referring again to FIGS. 2 and 3, a control mounting bracket 125 is connected to the second end 49 of platform 45. The control mounting bracket 125 includes handle 128 connected to the control mounting bracket 125. The handle 128 can be used to manipulate the sundeck handling attachment 42 and attached sundeck during installation of the sundeck onto a boat. The control mounting bracket 125 includes a base plate 127 connected to the platform 45. The base plate 127 is preferably angled upwardly from the platform 45. The control mounting bracket also includes an upright leg 131 that extends upwardly from the base plate 127. The base plate 127 and the leg 131 cooperate to give the bracket 125 an L-shaped configuration.

Referring to FIG. 4, a clamp control module 135 and a lift control module 145 are mounted on the control mounting bracket 125. The clamp control module 135 includes a plurality of buttons 138. The buttons 138 can be used to control the air cylinder 105, actuating the piston 106 and thereby causing the clamp structure 62 to open or close. Preferably, the clamp control module 135 is mounted on the upright leg 131 of the bracket 125.

The lift control module 145 includes two or more levers 148 used to control the lift 37 of articulated boom 20. One lever 148 can be used to cause the sundeck handling attachment 42 to be raised to a higher elevation, and another lever 148 can be used to cause the sundeck handling attachment 42 to be lowered. The lift control module 145 is preferably mounted on the base plate 127.

FIG. 6 illustrates the sundeck handling attachment 42 attached to a sundeck 205. As shown, the sundeck 205 has a first leg 210 connected to a second leg 212 at an angle. In the illustrated embodiment, the first leg 210 is shorter than the second leg 212. The first leg 210 has first and second surfaces 208, 209; and the second leg 212 has first and second surfaces 228, 229. To connect the sundeck 205 to a boat, a middle section 214 defined between the first and second surfaces 208, 209 of the first leg 210 is positioned between the fixed clamping member 95 and the moveable clamping member 115. In particular, the sundeck attachment 42 is manipulated so that the clamp structure 62 is positioned with the fixed clamping member 95 facing the first surface 208 and moveable clamping member 115 facing the second surface 209 of the sundeck 205. With the clamp structure 62 so positioned, the moveable clamping member 115 is clamped down on the surface 209 of the sundeck 205. The lift 37 is then used to lift the clamped sundeck 205 to a desired elevation, and the sundeck 205 manually moved to a location over the engine of the boat. As the sundeck 205 is moved, the arms of the articulated boom 20 pivot relative to one another to accommodate the movement. Once positioned over the engine, the sundeck is pivotally connected (e.g., by hinges and fasteners such as bolts) to the rear upper deck of the boat. During the connection process, the boom and lift assembly holds the clamped sundeck 205 at the desired position relative to the boat. After assembly, the engine can be accessed by pivoting the sundeck upwardly.

The above specification and examples provide a complete description of the manufacture and use of the composition of the invention. While a preferred use of the disclosed device is for handling the sundecks of boats, it will be appreciated that articles and manufacturing components could also be handled with the device. Since many embodiments of the invention can be made without departing from the spirit and scope of the invention, the invention resides in the claims hereinafter appended.

What is claimed is:

1. A method for mounting a sundeck to a boat, wherein the sundeck has a first leg connected to a second leg at an angle, the first leg being shorter than the second leg, and each of the first and second legs having first and second surfaces, the method comprising:

providing a clamp structure including two clamping members;

maneuvering the clamp structure so that a middle section of the first leg of the sundeck is positioned between the clamping members such that the two clamping members face first and second surfaces of the first leg, respectively;

closing the clamp structure to engage the sundeck;

lifting the sundeck with a boom and lift assembly connected to the clamp structure;

connecting the sundeck to a back region of the boat while the boom and lift assembly hold the clamped sundeck at a desired position relative to the boat; and disengaging the clamp structure from the sundeck when the sundeck is connected in the desired position.

* * * * *